United States Patent [19]

Bernardelli et al.

[11] 4,165,965

[45] Aug. 28, 1979

[54] BACKUP ROLL CLEANING SYSTEM FOR A HEATED ROLL FUSER

[75] Inventors: William J. Bernardelli, Longmont; Fred Y. Brandon, Boulder, both of Colo.

[73] Assignee: International Business Machines Corporation, Boulder, Colo.

[21] Appl. No.: 892,708

[22] Filed: Apr. 3, 1978

[51] Int. Cl.[2] ..... G03G 15/00

[52] U.S. Cl. ..... 432/75; 432/60; 15/256.51; 355/3 FU; 355/15; 101/425; 118/60; 34/120

[58] Field of Search ..... 432/60, 228, 75; 355/15, 3 FU; 219/216, 469; 15/256.51; 198/497, 499; 101/425; 118/60; 34/120

[56] References Cited

U.S. PATENT DOCUMENTS

| | | | |
|---|---|---|---|
| 3,017,618 | 1/1962 | Cross | 15/256.51 |
| 3,065,486 | 11/1962 | Scott | 15/256.51 |
| 3,292,201 | 12/1966 | Bedard | 15/256.51 |
| 3,626,833 | 12/1971 | Koch | 432/75 |
| 3,649,992 | 3/1972 | Thettu | 432/75 |
| 3,794,417 | 2/1974 | Machmer | 355/14 |
| 3,811,821 | 5/1974 | Ariyama et al. | 432/60 |
| 3,881,859 | 5/1975 | Hamilton | 432/75 |
| 3,934,549 | 1/1976 | Davidson | 355/15 |
| 3,940,282 | 2/1976 | Hwa | 15/256.53 |
| 3,957,423 | 5/1976 | Mueller | 432/60 |
| 3,970,038 | 7/1976 | Thettu | 432/75 |
| 3,986,227 | 10/1976 | Fathergill et al. | 355/15 |
| 4,042,415 | 8/1977 | Hwa | 355/15 |
| 4,080,159 | 3/1978 | Behum | 432/60 |

*Primary Examiner*—Henry C. Yuen

*Attorney, Agent, or Firm*—Pollock, Vande Sande & Priddy

[57] ABSTRACT

A hot roll fuser includes a heated roller and a substantially non-deformable backup roll forming a nip through which a carrier with unfused toner may pass, the toner becoming fused by virtue of the heating action from the hot roll. A cleaning arrangement for cleaning the backup roll comprises a support and a pair of scraping blades, each supported in contacting relationship with the backup roll. To insure good scraping action, each of the blades has a serrated or interrupted scraping edge, and the serrations or interruptions of the first and second blades are offset so that the entire surface area of the backup roll is scraped either by the first or second blades, or both.

19 Claims, 6 Drawing Figures

FIG. 2A
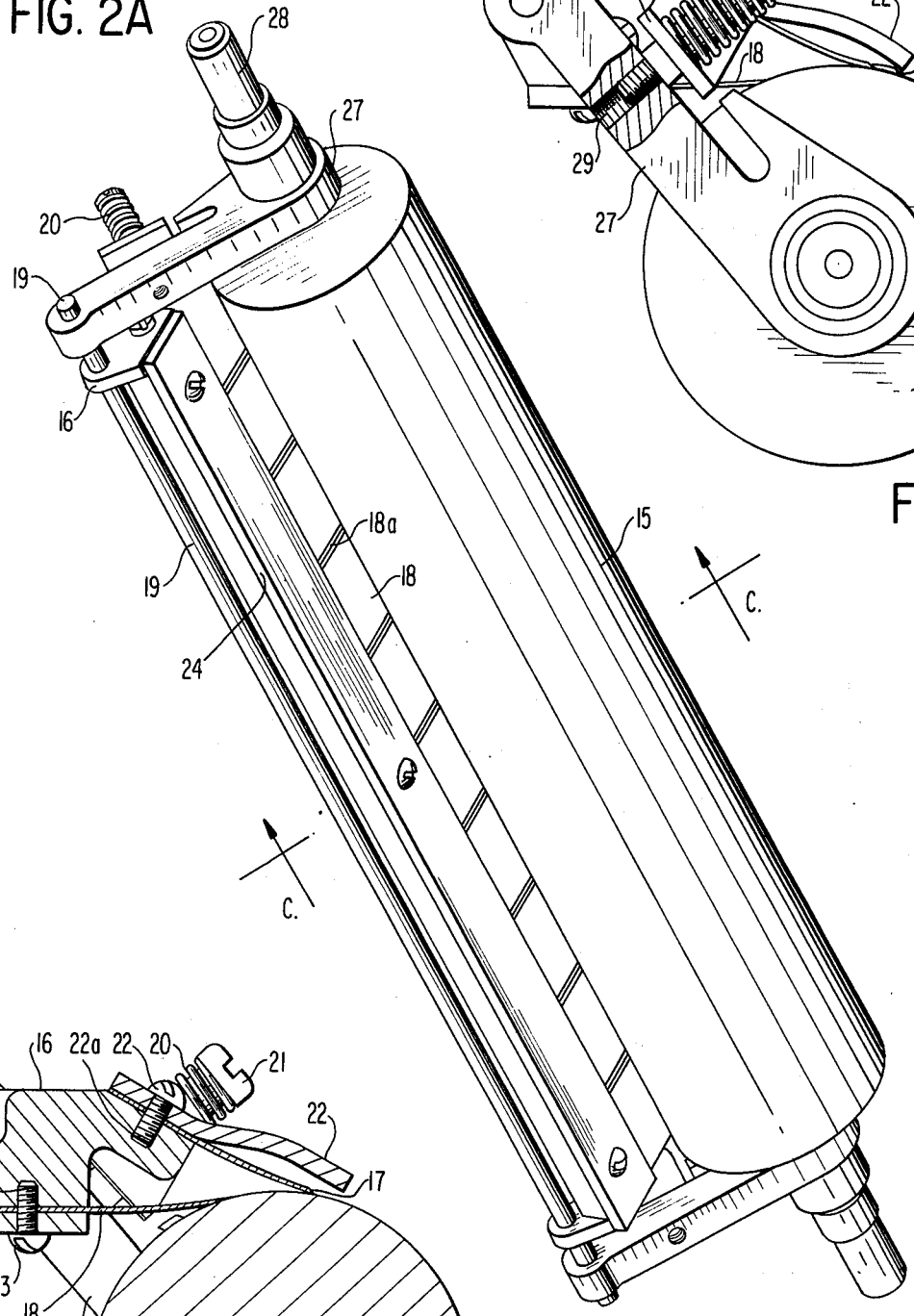
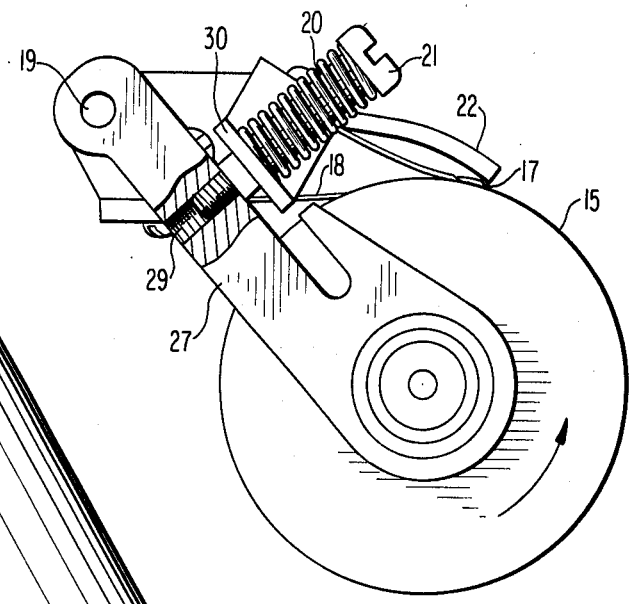
FIG. 2B
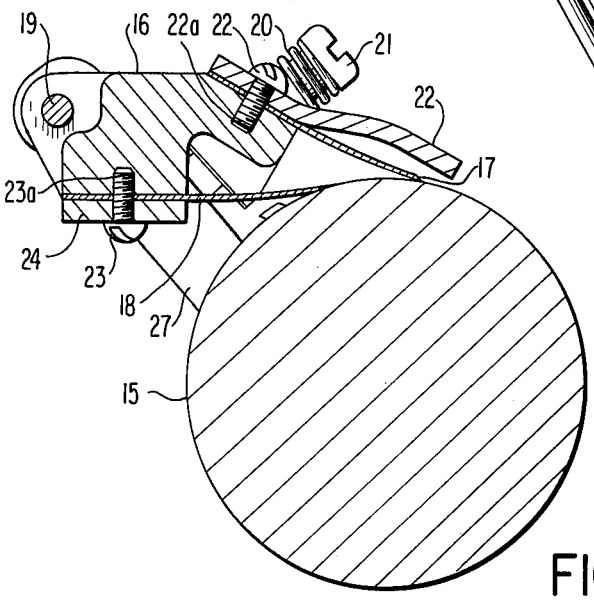
FIG. 2C

BACKUP ROLL CLEANING SYSTEM FOR A HEATED ROLL FUSER

FIELD OF THE INVENTION

The present invention relates to hot roll fusers for electrostatic copying machines, and more particularly, to a cleaning system for cleaning a backup roll in such a hot roll fuser.

BACKGROUND OF THE INVENTION

In the field of electrostatic copying employing fusable toners, various devices have been proposed to perform the fusing function, which devices rely upon radiant heat transfer, conductive heat transfer and even convective heat transfer. The present invention relates to apparatus relying upon conductive heat transfer and thus employs a hot roll fuser. The invention, however, is applicable to any appropriate roll fuser, heated or not. In hot roll fusers, desirably a backup roll is provided arranged so as to form a nip between the hot roll and backup roll. Preferably, the backup roll is relatively cooler than the hot roll.

With such an arrangement there is a tendency for toner to accumulate on the backup roll either from minor contact with the hot roll, from loose toner carried by air within the machine or from contact with a previously fixed copy which is passed through the roll pair for fixing an image on a reverse side. This toner must be cleaned from the backup roll for, although the toner may initially exist in a liquid state, toner accumulated on the backup roll can become sufficiently hard to emboss the carrier and may even lead to jamming of the fuser by preventing the carrier from passing through the nip.

The necessity for cleaning the backup roll is demonstrated by considering that, typically, the pressure between the hot roller and the backup roll is on the order of 130 to 140 lbs. per square inch and the hot roll temperature is in the range of 350°–370° (F.). Subjected to these conditions, toner on the backup roll can become hard enough, after being subjected to these conditions for a period of time, to actually emboss the carrier or paper passing through the roll pair. This is, of course, undesirable. Furthermore, the toner build-up on the backup roll, under the conditions of pressure and temperature normally encountered, can build up sufficiently to cause wrinkling of the carrier or paper and even jamming which necessarily results in terminating copier operation so that the jam can be removed.

Even before toner buildup on the backup roll becomes hard enough to cause embossing, sufficient heat is transferred to the backup roll to cause any toner located thereon to become tacky. Under these circumstances, the paper travelling through the paper path may tend to adhere to the backup roll which, of course, is also undesirable.

Prior art hot roll fusers have employed coated backup rolls coated to facilitate release. However, for a number of reasons, it would be desirable to employ a backup roll consisting of an uncoated conductor. One reason is cost; an uncoated roll is less expensive than a coated roll. Another reason is that electrostatic charging during image transfer to the paper tends to leave a residual charge on the paper. Desirably, this charge should be removed since it only inhibits proper paper flow. Clearly, a conductive backup roll will tend to "ground" the paper and drain off any residual charge thereon, whereas a coated backup roll will not perform this function, or will not perform it to the same extent.

A cleaning device for a coated backup roll comprises a scraper blade with a sharp leading edge composed of a plurality of individually flexible fingers for scraping toner from the backup roll is described in U.S. Pat. No. 3,794,417. Another cleaning arrangement employing a scraper blade for a backup roll in a hot roll fuser is shown in published patent application B579,116. The backup roll disclosed in both the aforementioned references comprises an aluminum cylinder with a thin surface coating such as polytetrafluoroethylene, aluminum oxide, chromium oxide or aluminum oxide imbedded within polytetrafluoroethylene.

Other arrangements for cleaning cylindrical surfaces in an electrostatic copier include that shown in U.S. Pat. No. 3,970,038 wherein a plurality of flexible fingers are supported for wiping contact, as opposed to scraping contact, with the fuser roll, or that shown in U.S. Pat. No. 3,940,282 wherein a pair of scraping blades are in contact with an image supporting surface.

It is an object of the present invention to provide a cleaning arrangement for an uncoated backup roller in a hot roll fuser. It is another object of the present invention to provide a cleaning arrangement which comprises a pair of scraper blades each having serrated or interrupted scraping edges in contact with the backup roll. It is a further object of the present invention to provide a cleaning arrangement of the foregoing type in which the serrations or interruptions of each scraper blade are offset with respect to the other such that the entire surface of the backup roll is scraped by either the first or the second scraper blade, or both. It is another object of the present invention to provide a cleaning arrangement for an uncoated backup roll which includes a flexible scraper blade, made flexible by the presence of serrations or interruptions in the blade surface which, at the same time, insures that all of the backup roll surface area is scraped by providing a second flexible scraper blade with serrations or interruptions in the surface of the scraper blade offset with respect to the first scraper blade.

SUMMARY OF THE INVENTION

These and other objects of the invention are met by providing in a roll fuser including a main roller, which may be heated and an uncoated backup roll forming a nip through which a carrier with unfused toner may pass, an improvement for cleaning the backup roll including a first scraper blade supported in contacting relation with the backup roll surface, a second scraper blade supported in contacting relation with the backup roll surface, each of the first and second blades having an interrupted surface contacting the backup roll thereby leaving areas of the backup roll surface unscraped by the first or second blade, with the first and second blades positioned so that their interruptions are offset with respect to each other to insure that a surface area of the backup roll unscraped by one of the blades is scraped by the other of the blades.

BRIEF DESCRIPTION OF THE DRAWINGS

The present invention will now be further described when taken in conjunction with the attached drawings in which like reference characters identify identical apparatus, and in which:

FIGS. 2A–2C show, respectively, the backup roll and scraping blade assembly, a side view and a cross-section;

DETAILED DESCRIPTION OF PREFERRED EMBODIMENTS

Figure 1:
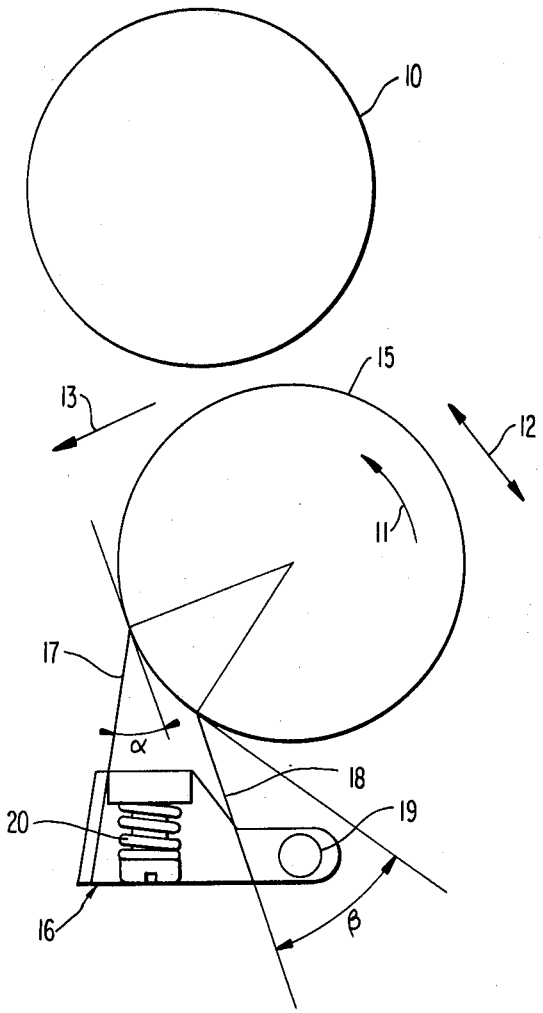
FIG. 1 is a schematic cross-section illustrating the relation between heated roller, backup roll and the pair of scraping blades.

FIG. 1 is a schematic illustration of one embodiment of the invention. As shown there, a hot roll fuser for an electrostatic copier machine includes a rotatable hot roller 10 which may comprise an aluminum core, with an internal heater, for example, a radiant energy heater, and a resilient coating thereon. Associated with the hot roll 10 is a backup roll 15. Backup roll 15 may comprise a steel, nickel plated or chrome plated steel roller which is mounted for rotation about its longitudinal axis in the direction of the arrow 11. The backup roll 15 is also mounted for movement relative to the hot roll 10 in the direction of the arrow 12. In its idle position, the backup roll 15 is moved away from the hot roll 10 and when copying is to commence, the backup roll 15 is moved in the direction of the arrow 12 into contact with the hot roll 10 forming a nip between the rolls. One or the other of the hot roll 10 or backup roll 15 is driven, and normally it is the backup roll 15 which is driven and the engagement between the backup roll 15 and the hot roll 10 causes rotation of the hot roll 10 as well as imparting a force to a paper sheet engaged in the nip to move the paper in the direction of the arrow 13. The combination of the pressure between the rolls 10 and 15 as well as the heat from the hot roll 10 causes fusing of toner on the paper to thereby fix the toner. As mentioned above, it is the primary object of the invention to maintain the backup roll 15 clean from dirt, dust and particularly toner.

To effect these ends, a scraper assembly is provided including a scraper body 16 which is fixed relative to the backup roll 15 and thereby moves with the backup roll when the backup roll is moved toward or away from the hot roller. The scraper body 16 supports a primary scraper blade 17 having a scraping edge in contact with the surface of the backup roll 15 and making an angle $\alpha$ with a tangent to the backup roll surface at the point of contact. The scraper body 16 also supports a secondary scraper blade 18 having a scraping edge in contact with the surface of the backup roll 15 and making an angle $\beta$ with a tangent to the backup roll surface at the point of engagement. The scraper body pivots about a pivot 19 under the force of a spring bias exerted by a bias spring 20 to load the primary and secondary blades 17 and 18 into proper scraping relationship with the surface of the backup roll 15. The bias or loading between blade and backup roll is adjusted by varying the tension of spring 20 as will be explained below.

Although the backup roll is cylindrical to a first approximation, desirably it is slightly tapered with the ends slightly greater in diameter than the center. To ensure good scraping action, therefore, the blades should not be so stiff that they cannot follow the backup roll contour. To decrease the stiffness of the blades, the scraping edge is interrupted or serrated. To ensure that the entire surface of the backup roll is scraped, the interruptions or serrations of the two blades are offset with respect to each other. Desirably, the serrations are wide enough and deep enough to allow toner beads to pass without becoming trapped.

FIGS. 2A, 2B and 2C illustrate, respectively, an assembly view, an end view and a typical cross-section of the scraper assembly and backup roller. As shown in FIG. 2A, for example, the backup roller 15 rotates about, and is driven by a shaft 28. Also supported on the shaft 28 and fixed against longitudinal movement or rotation are a pair of scraper assembly arms 27, one at each end of the backup roller 15. The scraper body 16 assembly is supported on and pivoted about a pivot shaft 19 supported between the arms 27. As shown more clearly in FIG. 2C, the scraper body 16 has a primary scraper blade 17 and a secondary scraper blade 18 attached thereto. More particularly, the scraper body 16 may comprise an elongated body slightly longer than the backup roll 15 and of generally L-shaped cross-section with a hole running longitudinally therethrough for pivot shaft 19. Pairs of groups of tapped holes **22*a* in one surface and 23*a* in another surface of the body 16 are provided for attaching the scraper blades 17 and 18 to the scraper body 16. Each of the blades are provided with a series of holes so that a plurality of screws 22 and 23 can secure the blades to the body. Associated with scraper blade 17 is a cover 22 which serves both to secure the blade to the body as well as to protect the same. Similarly, a cover 24 is associated with the blade 18** for securing purposes.

For the purpose of loading the blades against the surface of the backup roll 15, each of the scraper assembly arms 27 includes a tapped hole 29 at least partially therethrough. The scraper body 16 includes generally planar extensions 30 which overlie the tapped holes 29 in the scraper assembly arms 27 when the scraper body 16 is in its assembled position. A spring 20 secured between the extensions 30 and the head of a screw 21 provides a bias for loading the blades against the backup roll surface as the screw 21, which is threaded into the hole 29, is tightened. Loading force may be adjusted merely by rotating the screw 21.

While the backup roll 15 is generally cylindrical in shape, it preferably includes a slight taper so that the diameter of the backup roll 15 adjacent the center of the roll, is slightly less than the diameter of the roll adjacent its ends. To increase the compliance of the blades, and to insure that they conform to the surface of the backup roll 15 at least the scraping edge and preferably a substantial extent of the width of the blade includes a plurality of interruptions or serrations. This increased compliance of the blade is desirable even if the backup roll 15 is substantially cylindrical without the taper.

Figure 3A:
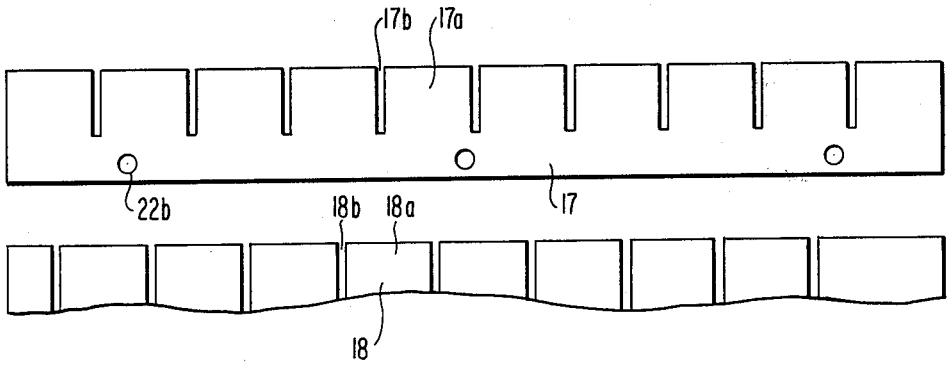
FIG. 3A shows a developed plan view of the blades illustrating the relationship between their serrations.
Figure 3B:
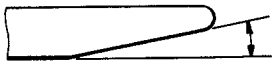
FIG. 3B is an end view of a typical blade in the vicinity of the scraping edge.

FIGS. 3A and 3B are, respectively, a developed plan view of a typical blade such as the primary blade 17 and its relation to the secondary blade 18, and an end view of a typical blade in the vicinity of the scraping edge. More particularly, as shown in FIG. 3A, the blade 17 comprises a generally rectangular blade having a plurality of holes **22*b* to allow the screws 22 to pass therethrough for the purpose of securing the blade to the scraper body 16. The scraping edge portion of the blade is interrupted or serrated such that the blade itself comprises a plurality of blade sections 17*a*, separated by serrations or interruptions 17*b*. In a typical embodiment, for example, each blade may be 8.75 inches long with each of the serrations 17***b* being 0.072 inches wide or wider. For the embodiment shown in FIG. 3A, each blade comprises ten sections 17*a*.

While the serrations are effective to increase the compliance of the blade and insure that it lies in effective scraping relationship with respect to the entire surface of the backup roll 15, the interruptions or serrations 17*b* allow toner to build up in stripes at the locations of the serrations or interruptions. In order to remove the stripes or to prevent their production, the secondary blade 18 has its serrations or interruptions 18*a* offset with respect to the serrations or interruptions 17*a* of the primary blade 17. Thus, FIG. 3A also shows a broken top view of the secondary blade 18 showing the relationship between the serrations 18*b* and 17*b*, when both blades are mounted on the blade assembly body 16. Those skilled in the art will understand that the number of sections and hence the number of serrations in any blade can be varied although, of course, as the number of serrations or interruptions is reduced, so is the compliance of the blade. At the same time, there is no necessity that the serrations 18*b* are located at the midpoint of the serrations 17*b*, so long as the serrations or interruptions are sufficiently offset so as to preclude the buildup of a toner stripe on the surface of the backup roll 15 being scraped.

FIG. 3B is a cross-section of the edge area of the scraper blade showing that the blade, which may be 0.006 inches in thickness, has a bevel adjacent the scraping edge, preferably, the bevel is 45°, although this particular amount of bevel is not critical. In addition, the extreme edge of the scraping edge of the blade has a tip radius on the order of 0.001 inches. A suitable material for both blades is spring steel.

In operation, with the scraper assembly as shown in FIGS. 2A–2C mounted to the shaft 28, the primary blade 17 makes an angle to the tangent to the backup roll at its point of contact of about 21°, which angle is changed as the blade is loaded by rotation of the screw 21. In the embodiment we have produced, with a load of 0.256 pounds per inch, the 21° angle is reduced to 19°. Secondary blade 18 makes an angle which is about 20°, either loaded or unloaded. In view of the fact that the scraper assembly and the blades are mounted to the shaft supporting the backup roll 15, movement of the backup roll into and out of contact with the hot roll 10 does not change the relationship of the scraper body or blades to the backup roll. At the same time, removal of the pivot shaft 19 and the loading screws 21 allows the scraper blade assembly to be removed from the backup roller arms 27 and thereby removed from the apparatus.

From the foregoing, those skilled in the art will appreciate that, when loaded, each of the primary and secondary scraper blades lifts contaminants off the surface of the backup roller 15 except for the area in which serrations or interruptions exist in the blade edge. The mounting and arrangement of serrations in the pair of blades insures that the serrations or interruptions do not "line up" and thus the entire surface of the backup roll 15 is cleaned.

As mentioned above, preferably the scraper blades comprise spring steel, the scraper body 16 can be either steel or die-cast aluminum, the covers 22 and 24 are preferably aluminum and while the backup roll 15 has been disclosed as comprising steel or plated steel, it can also be an aluminum core covered with a Teflon® based polymer or other low surface energy material.

What is claimed is:

1. In a roll fuser including a main roller and a backup roll with surfaces of said main roller and said backup roll forming a nip through which a carrier with unfused toner may pass, an improvement for cleaning said backup roll comprising:

a first scraper blade, a second scraper blade, support means for supporting said first and second scraper blades in a fixed position with respect to said backup roll with each said blade in contacting relationship with the surface of said backup roll, both said first and second scraper blades having a scraping edge with an interrupted surface contacting said backup roll to thereby leave areas of said backup roll surface unscraped by said first or second scraper blade, interruptions in said first scraper blade offset with respect to interruptions in said second scraper blade whereby at least one backup roll surface area unscraped by said first blade is scraped by said second blade.

2. The apparatus of claim 1 wherein interruptions in said first and second scraper blade edges are located at regular equal intervals along said first and second scraper blades.

3. The apparatus of claim 1 wherein said backup roll is mounted on a shaft for rotatable movement and in which said support means includes:

a pair of arms mounted on said shaft, a pivot shaft secured between said arms, and body means supporting said first and second scraper blades for pivotal movement about said pivot shaft.

4. The apparatus of claim 3 which includes biasing means biasing said body means against said arms for rotatable movement about said pivot shaft for loading said blades against said backup roll.

5. The apparatus of claim 1 wherein each of said first and second scraper blades is supported by said support means at an angle of about 20° to a tangent to said backup roll at a point of contact between the associated blade edge and backup roll surface.

6. The apparatus of claim 5 in which said support means includes:

loading means to bias said blades against said backup roll and in which said support means supports said first scraper blade at an angle of about 19° with a tangent to said backup roll when loaded against said backup roll by said loading means.

7. The apparatus of claim 1 wherein said backup roll comprises an uncoated steel roll and wherein each of said first and second scraper blades comprise spring steel.

8. The apparatus of claim 1 wherein said backup roll comprises a plated steel roll and wherein each of said first and second scraper blades comprises spring steel.

9. The apparatus of claim 1 wherein said first scraper blade has interruptions in said edge spaced at regular intervals, said second scraper blade has interruptions in said edge spaced at regular intervals, and in which blade interruption in said first blade are offset with respect to interruptions in said second blade.

10. A roll fuser for an electrostatic copying machine including:

a main roll, mounted on a first shaft, a backup roll, mounted on a second shaft, means for rotating a one of said main or backup rolls and for forming a nip therebetween for transferring paper and simultaneously fusing toner on said paper, a backup roll cleaning means including:

a pair of serrated scraper blades, means for supporting said blades in scraping relation to said backup roll with serrations in a first blade offset with respect to serrations in said second blade.

11. The apparatus of claim 10 in which serrations in said first blade are located at regular intervals along said blade and in which serrations in said second blade are located at regular intervals along said second blade.

12. The apparatus of claim 10 in which means for supporting includes:

a pair of arms mounted on said second shaft, a pivot shaft secured between said arms, and body means supporting said pair of serrated scraper blades and mounted for pivotable movement about said pivot shaft.

13. The apparatus of claim 12 which includes biasing means biasing said body means against said arms for loading said serrated blades against said backup roll.

14. The apparatus of claim 13 in which each of said blades makes an angle of about 20° relative to said backup roll at a tangent to said backup roll at a contact point.

15. The apparatus of claim 14 wherein each of said blades comprise spring steel.

16. The apparatus of claim 15 wherein said backup roll comprises uncoated steel.

17. The apparatus of claim 15 wherein said backup roll comprises plated steel.

18. The apparatus of claim 17 wherein said backup roll comprises chrome plated steel.

19. The apparatus of claim 17 wherein said backup roll comprises nickel plated steel.

* * * * *